US011702799B2

(12) United States Patent
Ma et al.

(10) Patent No.: US 11,702,799 B2
(45) Date of Patent: Jul. 18, 2023

(54) BASE PLATE FOR SUPPORTING A RAIL FOR A RAIL VEHICLE AND FASTENING POINT HAVING PLATE OF THIS TYPE

(71) Applicant: Vossloh Fastening Systems GmbH, Werdohl (DE)

(72) Inventors: Hongchao Ma, Dortmund (DE); Winfried Bösterling, Neuenrade (DE); Serdar Gözsüz, Herscheid (DE)

(73) Assignee: Vossloh Fastening Systems GmbH, Werdohl (DE)

( * ) Notice: Subject to any disclaimer, the term of this patent is extended or adjusted under 35 U.S.C. 154(b) by 266 days.

(21) Appl. No.: 16/496,606

(22) PCT Filed: Mar. 21, 2018

(86) PCT No.: PCT/EP2018/057127
§ 371 (c)(1),
(2) Date: Sep. 23, 2019

(87) PCT Pub. No.: WO2018/172396
PCT Pub. Date: Sep. 27, 2018

(65) Prior Publication Data

US 2021/0222372 A1 Jul. 22, 2021

(30) Foreign Application Priority Data

Mar. 24, 2017 (DE) ..... 10 2017 106 422.2

(51) Int. Cl.
*E01B 9/02* (2006.01)
*E01B 9/40* (2006.01)

(52) U.S. Cl.
CPC . *E01B 9/02* (2013.01); *E01B 9/40* (2013.01)

(58) Field of Classification Search
CPC ..... E01B 9/02; E01B 9/40; E01B 9/38; E01B 9/44; E01B 9/46; E01B 9/48; E01B 9/483; E01B 9/486; E01B 9/54
See application file for complete search history.

(56) References Cited

U.S. PATENT DOCUMENTS 2,424,916 A * 7/1947 Stedman ..... E01B 7/22 238/283
3,876,141 A * 4/1975 French ..... B66C 7/08 238/349

(Continued)

FOREIGN PATENT DOCUMENTS

CN 106245470 A 12/2016
DE 3622860 A1 1/1988

(Continued)

*Primary Examiner* — Mark T Le
(74) *Attorney, Agent, or Firm* — The Webb Law Firm

(57) ABSTRACT

A base plate, which is made of plastic and is intended for supporting a rail for a rail vehicle on a substrate, may include a lower face, and an upper face on which a supporting surface for the rail is formed, a recess, from which a passage leads to the upper face of the base plate, being formed in the lower face of the base plate, the diameter of the recess in a direction transverse to the longitudinal axis of the passage being greater at least in part than the diameter of the passage, so that a stop for an insert piece fitted into the recess is formed on the top surface, assigned to the upper face of the base plate of the recess.

15 Claims, 3 Drawing Sheets

(56) References Cited

U.S. PATENT DOCUMENTS

| | | | | |
|---|---|---|---|---|
| 4,061,269 | A * | 12/1977 | Hixson | E01B 5/18 238/17 |
| 10,214,863 | B2 | 2/2019 | Bednarczyk et al. | |
| 2008/0179419 | A1 | 7/2008 | Vives Clavel | |
| 2008/0265050 | A1* | 10/2008 | Osler | E01B 9/10 238/315 |
| 2009/0084864 | A1* | 4/2009 | Bosterling | E01B 9/483 238/349 |
| 2011/0068183 | A1 | 3/2011 | Bednarczyk | |
| 2011/0068184 | A1* | 3/2011 | Rademacher | E01B 9/42 238/282 |
| 2015/0008265 | A1 | 1/2015 | Harrass et al. | |
| 2016/0017545 | A1 | 1/2016 | Bosterling et al. | |
| 2016/0230352 | A1* | 8/2016 | Bednarczyk | E01B 9/22 |

FOREIGN PATENT DOCUMENTS

| | | | |
|---|---|---|---|
| DE | 102012100440 | A1 | 7/2013 |
| EP | 1950347 | A2 | 7/2008 |
| EP | 2851468 | A1 | 3/2015 |
| WO | 2011032974 | A1 | 3/2011 |
| WO | 2014139925 | A1 | 9/2014 |
| WO | 2015040118 | A1 | 3/2015 |

* cited by examiner

BASE PLATE FOR SUPPORTING A RAIL FOR A RAIL VEHICLE AND FASTENING POINT HAVING PLATE OF THIS TYPE

CROSS REFERENCE TO RELATED APPLICATIONS

This application is the United States national phase of International Application No. PCT/EP2018/057127 filed Mar. 21, 2018, and claims priority to German Patent Application No. 10 2017 106 422.2 filed Mar. 24, 2017, the disclosures of which are hereby incorporated by reference in their entirety.

BACKGROUND OF THE INVENTION

Field of the Invention

The invention relates to a base plate which is made of plastic and is intended for supporting a rail for a rail vehicle on a substrate, the base plate comprising a lower face, assigned to the substrate, and an upper face on which a supporting surface for the rail is formed, a recess, from which a passage leads to the upper face of the base plate, being formed into the lower face of the base plate, the diameter of the recess in a direction transverse to the longitudinal axis of the passage being greater at least in part than the diameter of the passage, so that a stop for a component fitted into the recess is formed on the top surface, assigned to the upper face of the base plate, of the recess, and an additional abutment for rotationally secure support of the component part respectively fitted into the recess being provided on an inner surface surrounding the recess.

The invention furthermore relates to a fastening point at which a rail for a rail vehicle is fastened.

Description of Related Art

EP 1 950 347 A2 has proposed a base plate of the type mentioned in the introduction. The known base plate comprises, on its lower face assigned to the solid substrate, a stiffening structure which is formed from intersecting ribs, which respectively delimit between them unfilled recesses. In addition, passages are formed into the base plate, through which a conventionally shaped hexagonal screw, used as a clamping screw, can be passed in order to clamp a tensioning clamp against the base plate. For the screw head of the clamping screw, in this case a likewise hexagonally configured recess formed into the lower face of the base plate is provided, in which the screw head is seated in a form-fit manner as a component to be held in a torque proof manner in this recess in the fully assembled state. In order to permit sufficiently firm holding, in the known base plate there are respectively three passages on its narrow sides, through which a fastening screw that can be screwed into the solid substrate is respectively passed.

A problem may arise with base plates made from plastic if large forces and along with high tightening torques are required for clamping the respective spring element. In this case, there is the risk that the abutments present in the recess intended for the screw head are too weak to withstand the loads, which are generally concentrated onto a linear contact. The consequence is that material breaks out of the enclosure of the recess and sufficient holding is no longer ensured for the screw.

In order to solve this problem, it has been proposed in WO 2011/032974 A1, for secure mounting of a polygonal screw head in a recess of a base plate of the type mentioned above, to assign each side surface of the screw head a bearing surface, which is configured on the circumferential wall of the receptacle and extends over a sublength of the respectively assigned side surface of the screw head and on which the relevant side surface of the screw head is supported flat in the assembled state. In this case, the bearing surfaces of the circumferential wall are arranged at a distance from one another. Formed between two neighbouring bearing surfaces into the circumferential wall of the receptacle, there is respectively a recess, in the region of which in the fully assembled state there is no contact between the screw head and the circumferential wall of the receptacle. In this way, flat bearing of the outer circumferential surfaces on the assigned inner surfaces of the recess is achieved, and load concentration in the region of the corner in which the inner surfaces of the recess meet one another is avoided.

The base plates explained above assume that the clamping element respectively provided for clamping the spring element comprises a polygonal screw head and is introduced into the assigned recess from the lower face of the base plate. This assumes that the clamping elements are already mounted on the base plate before they are set onto the substrate.

Retrospective fastening of clamping elements on a base plate already mounted on the substrate allows so-called "locking screws". Their screw heads have an elongated shape with a width which is generally restricted to the diameter of the screw shaft. In order to fasten such a locking screw from the upper face on a base plate, the passage leading to the assigned recess on the lower face is shaped in a slit-like fashion and is in this way dimensioned in such a way that the locking screw with its elongated head can be fed through the passage with slight clearance. The recess itself is widened in its region adjacent to the orifice of the passage in such a way that the head of the screw, as soon as it is fully introduced into the recess, can be swivelled about the longitudinal axis of the screw to such an extent that the parts of it protruding laterally beyond the screw shaft are swivelled out of the opening region of the passage. Conventionally, a quarter revolution about the longitudinal axis is provided. The swivelling range is in this case conventionally limited by two counter-bearings, on which the head of the screw bears with a side surface when reaching its desired fastening position.

Practical experience shows that, even with the clamping of spring elements by means of the clamping element coupled to the base plate in the manner described above, problems may arise when the surrounding conditions are critical or very high clamping loads are intended to be applied.

Against this background, the object has been identified to provide a base plate made of plastic and a fastening point equipped with such a base plate, in which the base plate withstands even large loads and under unfavourable operating conditions.

SUMMARY OF THE INVENTION

A fastening point according to the invention achieves the object mentioned above.

Advantageous configurations of the invention will be explained in detail below.

A base plate according to the invention is accordingly made of plastic and intended for supporting a rail for a rail vehicle on a substrate. In this case, a base plate according to the invention comprises a lower face, assigned to the substrate, and an upper face on which a supporting surface for the rail is formed. However, in a manner likewise known per se, a recess, from which a passage leads to the upper face of the base plate, is formed into the lower face of the base plate, the diameter of the recess in a direction transverse to the longitudinal axis of the passage being greater at least in part than the diameter of the passage, so that a stop for a component fitted into the recess is formed on the top surface, assigned to the upper face of the base plate, of the recess, and an additional abutment for rotationally secure support of the component part respectively fitted into the recess being provided on an inner surface surrounding the recess.

According to the invention, in such a base plate, the component fitted into the recess is now an insert piece which is made of a material having a higher strength compared with the plastic material of the base plate and is supported with a counter-bearing, formed on one of its outer surfaces, on the abutment of the recess and with its upper face against the top surface of the recess. The insert piece in this case comprises a lower face, assigned to the lower face of the base plate, starting from which a recess, in which a passage likewise formed into the insert piece and aligned flush with the passage of the base plate opens, is formed into the insert piece, the recess of the insert piece being configured for rotationally secure reception and support of a head of a screw-like clamping element, the threaded shank of which is fed during use through the passages of the insert piece and of the base plate.

A fastening point configured according to the invention, at which a rail for a rail vehicle is fastened on a substrate, accordingly comprises a base plate configured according to the invention, on the supporting surface of which the rail is supported, a spring element which exerts a resiliently elastic retaining force on the foot of the rail to be fastened, a screw-like clamping element which comprises a head, with which it is held rotationally securely in the recess of the insert piece seated in the recess of the base plate, and a threaded shank which is formed onto the head, which is fed through the passages of the insert piece and of the base plate and onto which a nut, which is supported on the clamping element by means of the spring element, is screwed.

A base plate according to the invention is therefore configured in such a way that the screw-shaped clamping element provided for clamping the spring element at the respective rail fastening point is no longer supported directly on the plastic material of the base plate. Rather, in a base plate according to the invention, an insert piece is seated in the recess of the base plate, intended for supporting the clamping element. This insert piece is in this case shaped and dimensioned in such a way that it fits perfectly into the recess assigned to it. Thus, the insert piece may readily be configured, while avoiding sharp edges, in such a way that it presses onto the inner surfaces of the recess over a large area. In particular, the region of the contact between the abutment of the recess and the counter-bearing of the insert piece may be configured in such a way that a tightly bearing large-area contact is ensured. Even under high tightening torques, high local stress peaks can thus be avoided and optimal alignment of the insert piece in the assigned receptacle is ensured. The good form-fit seating of the insert piece in this case reliably prevents relative movements between the material, surrounding the recess, of the base plate and the stronger material of the insert piece, which may cause friction wear.

In principle, for the production of the insert piece, any material which has a sufficient load-bearing capacity is suitable. Here, sufficiently strong, highly load-bearing plastic materials are also possible, which are for example reinforced with high-performance fibres in such a way that they withstand the loads occurring during use. From the viewpoint of production and cost, metal materials, in particular light metal or steel materials, have also been found to be advantageous variants of the invention. Insert pieces provided according to the invention may be shaped therefrom by a machining process or casting technology. In particular, production by casting technology has been found to be favourable in this case since it allows the inserts to be produced in large batch numbers with an optimised property profile.

In principle, in the case of a base plate according to the invention and the insert provided thereon, it is possible to shape the passage cylindrically and to configure the clamping element in such a way that it can be fed through such an opening and subsequently locked in the recess of the insert piece. To this end, the clamping element may for example in the manner of a hook or in the manner of a hollow dowel carry along a locking element which is fastened flexibly on it, and which swivels into its locking position when reaching the recess of the insert piece.

A configuration of the invention which is particularly practical in terms of the shaping of the passages is, however, characterised in that at least the passage of the insert piece has a non-circular opening cross section. In order to be able to use conventional locking screws, which have already proven suitable for rail fastenings, for this purpose, the opening cross section may have a rectangular shape. This shape of the passage makes it possible to use conventional locking screws, the configuration and functionality of which have already been described above. The recess of the insert piece may in this case be shaped in such a way that, in order to lock the clamping element, it may for example be swivelled through a quarter revolution about its longitudinal axis in the recess, as soon as it has passed with its head through the passages of the base plate and of the insert piece.

Secure support of the insert piece inside the assigned recess of the base plate against the tightening torques which act via the clamping element coupled to it during use onto the insert piece may be achieved in that the abutment of the recess of the base plate is formed on an inner circumferential surface of the recess and the counter-bearing of the insert piece is formed on an outer circumferential surface of the insert piece.

In this case, a more uniform distribution of the loads acting on the insert piece during use and transmitted onto the base plate may be achieved in that at least two distributed abutments of the recess of the base plate are provided, and an equal number of counter-bearings of the insert piece, which are shaped and arranged in accordance with the abutments, are provided. Optimally, to this end the abutment of the recess of the base plate and the counter-bearing of the insert piece are distributed at the same intervals around the longitudinal axis of the passages of the base plate and insert piece. For example, it has been found expedient for two abutments and counter-bearings to be arranged at 180° to one another in relation to the longitudinal axis of the passages.

A heel may be formed onto the upper face of the insert piece. This heel may, on the one hand, contribute to rotational securing as a counter-bearing, by its engaging into a correspondingly shaped opening or depression which is formed into the base plate starting from the top surface of the recess of the base plate. A heel optionally provided on the upper face of the insert piece may, however, also engage into the passage of the base plate if the latter is widened at least in sections in such a way that the heel finds space in it next to the shaft, fed through it during use, of the clamping element. A configuration which assists correct positioning of the insert piece in relation to the clamping element or the assigned passage of the base plate in this regard optionally consists in the passage of the insert piece extending through the heel in such a way that the heel bounds the passage at least on two opposite sides. A heel shaped and arranged in such a way may engage into the assigned passage of the base plate when the insert piece is fitted into the assigned recess and thus automatically bring about centring of the insert piece in relation to the passage.

This may, in particular, be ensured in that the heel is configured as a conical heel, the circumferential surfaces of which are inclined starting from the upper face of the insert piece in the direction of the longitudinal axis of the passages of the base plate and insert piece. In order to additionally assist this, a seat for the conical heel, which is shaped in accordance with the conical heel, may be formed in the region in which the passage of the base plate meets the top surface of the recess of the base plate.

Additional load relief of the material surrounding the insert piece may furthermore be achieved in that the size and shape of the passage of the base plate and the size and shape of the heel optionally available at the upper face of the insert piece are matched to one another in such a way that the heel is aligned with its free upper face at least flush with the upper face of the base plate or protrudes beyond the upper face of the base plate. The heel extending in this case at least as far as the upper face of the base plate may, during use, act against the lower face of a component additionally applied and clamped against the substrate by means of the respective clamping element or another fastening element, which may for example be a guide plate for lateral guiding of the rail to be fastened. By the additional support achieved in this way for the insert piece on a component bearing on the base plate, the loads that act during use on the material, present between the upper face of the base plate and the top surface of its recess, of the base plate may be reduced further.

The base plate may in the conventional way have a rectangular base shape in plan view. It goes without saying that individual sections of the base plate may differ from a strictly rectangular shape. In particular, the rectangular base shape includes the possibility of configuring individual or several corner regions of the base plate in a rounded fashion.

In the case of a base plate which is rectangular in its base shape, the supporting surface on which the rail is supported during use is expediently arranged centrally in relation to the length of the base plate. A recess with an insert piece seated therein may then respectively be formed in the sections of the base plate which protrude laterally beyond the rail. This is found to be expedient in particular when a base plate configured in such a way is used in a fastening point according to the invention.

In addition to the recess, at least one passage may be formed in the base plate according to the invention, said passage leading from the upper face to the lower face of the base plate, through which a fastening screw that fixes the base plate on the substrate is fed at a fixing point according to the invention.

In the case of a base plate according to the invention having a centrally arranged supporting surface and side sections, which protrude laterally therefrom and into which at least one passage for a fastening screw and at least one recess equipped according to the invention with an insert piece are formed, with the view to distribution of the loads occurring, it is found particularly favourable for the recesses with the insert pieces and the additional passages to be arranged point-symmetrically as seen in a plan view of the base plate.

A grid structure may be formed in a manner known per se into the lower face of a base plate according to the invention, in order to ensure optimal rigidity of the base plate with minimised weight.

Likewise, at least one shaped element for supporting or guiding at least one component additionally arranged on the base plate may be formed on the upper face of the base plate. This component may, for example, be the spring element which, with appropriate shaping of the base plate, is supported directly thereon. A configuration in which the upper face of the base plate is configured for bearing and supporting a guide plate, on which the rail is laterally guided during use, is found to be particularly practical and versatile. To this end, the shaped element may be a shoulder and the additional component may be a guide plate, which forms a lateral guide for the rail with its end surface assigned to the rail and is supported on the shoulder with its opposite end surface, the guide plate comprising a passage, through which the threaded shank of the clamping element is fed, aligned flush with the passages of the base plate and of the insert piece, and the spring element being supported on the guide plate.

BRIEF DESCRIPTION OF THE DRAWINGS

The invention will be explained in more detail below with the aid of a drawing which represents an exemplary embodiment. The figures show, in each case schematically.

DESCRIPTION OF THE INVENTION

At the rail fastening point 1, a rail S is fastened on a solid substrate U (shown here only in sections), formed for example by a concrete sleeper.

Figure 1:
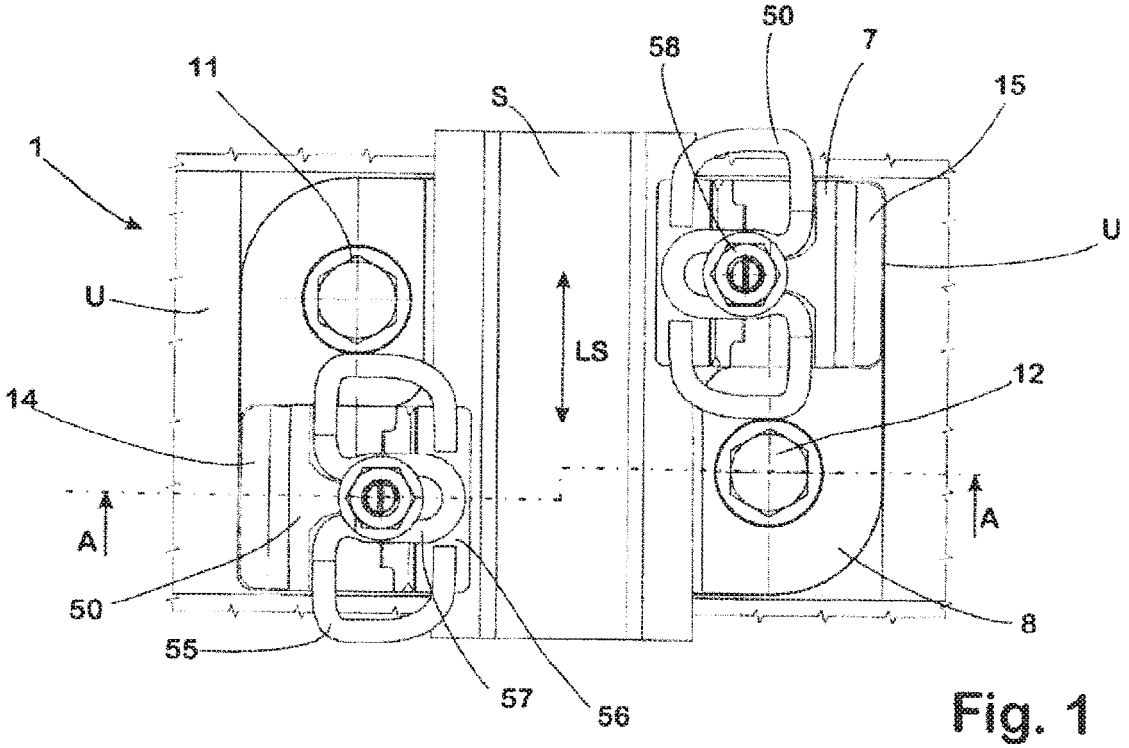
FIG. 1 a fastening point according to the invention for a rail for a rail vehicle in a view from above.
Figure 2:
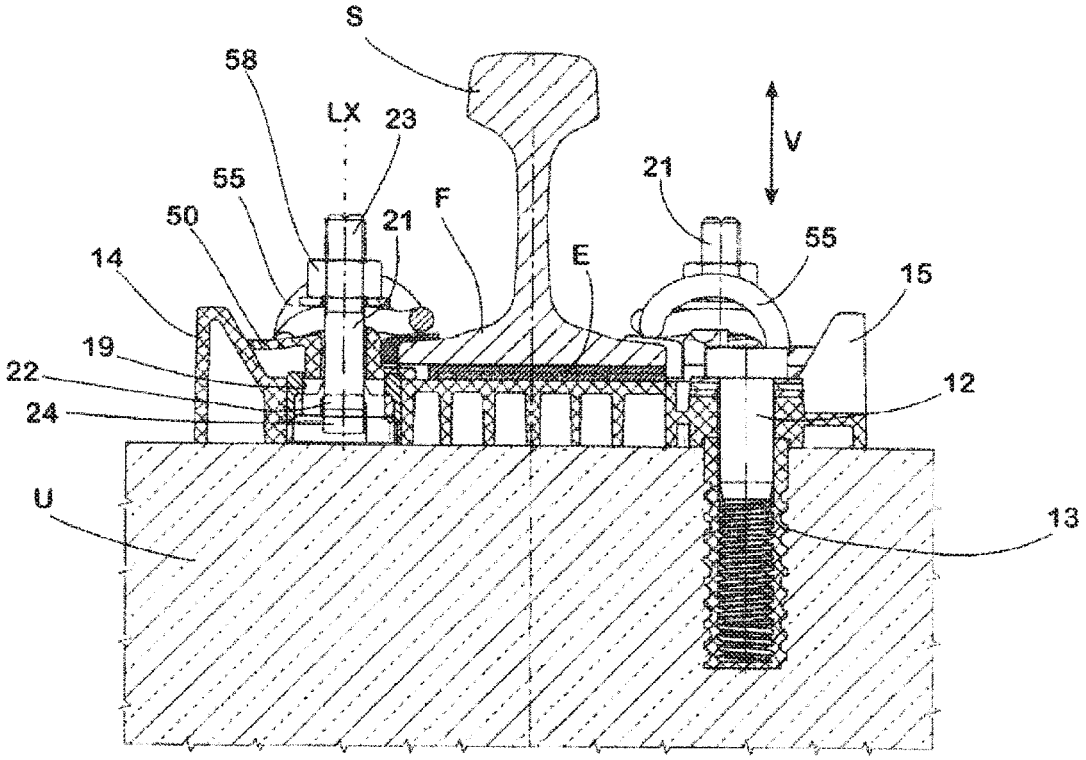
FIG. 2 the fastening point according to FIG. 1 in a section along the section line A-A indicated in FIG. 1.
Figure 3:
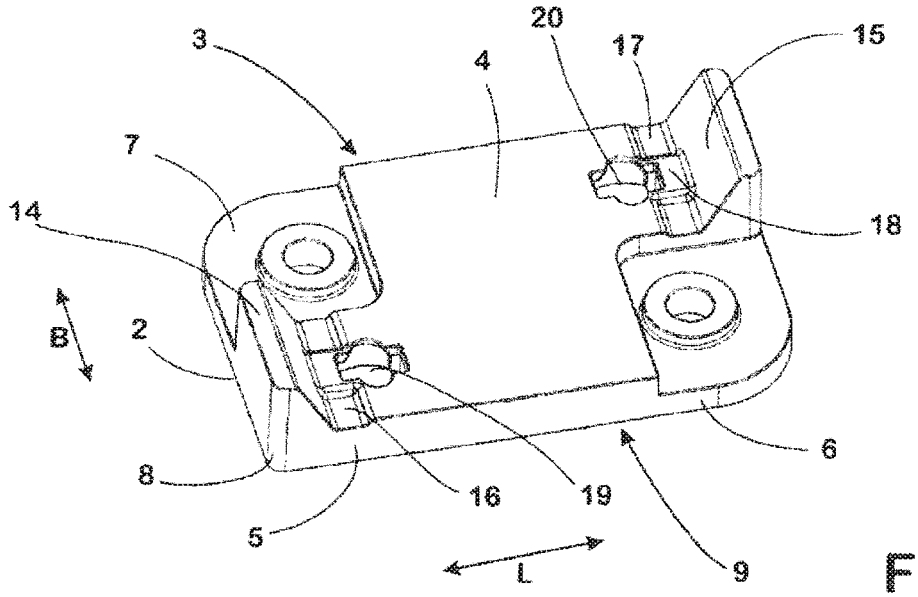
FIG. 3 a base plate according to the invention in perspective view.

The rail fastening point 1 comprises a base plate 2, which has a rectangular configuration in plan view (FIG. 1) on its free side 3 and has a supporting surface 4 arranged centrally in relation to its length L, on which the rail S is supported with its rail foot F. Arranged between the supporting surface 4 and the lower face of the rail foot F, there is in this case a resilient layer E which imparts a certain resilient flexibility, directed in the vertical direction V, to the supporting of the rail S in relation to the substrate U.

The base plate 2 is made from a plastic material which is established for this purpose in the prior art.

The two side sections 5, 6, protruding laterally from the supporting surface 4, are configured point-symmetrically as seen in plan view. In this case, again as seen in plan view, one corner region 7 of the side sections 5, 6 is respectively rounded, whereas another corner region is pronouncedly angular. A passage 10 extending from the upper face 3 to the lower face 9 of the base plate 2 is respectively formed centrally in the corner region 8. The threaded shank respectively of a fastening screw 11, 12, with which the respective fastening screws 11, 12 are respectively screwed into a dowel 13 placed in the substrate U, is fed through the passages 10. The base plate 2 is fixed on the substrate U by means of the fastening screws 11, 12.

In the respective other corner region 7 of the side sections 5, 6, a shoulder 14, 15 raised in the vertical direction V, the side of which assigned to the rail S is chamfered, is respectively formed adjacent to the respective narrow side of the base plate 2. The chamfered side of the shoulder 14, 15 ends at the foot of the respective shoulder 14, 15 in a channel 16, 17, which extends parallel to the longitudinal direction LS of the rail S and is divided into two parts by a web 18 aligned transversely to the shoulder 14, 15 and to the longitudinal direction LS.

At the height of the web 18, a passage 19, 20 leading from the upper face 3 to the lower face 9 of the base plate 2 is respectively provided between the respective channels 16, 17 and the assigned edge of the supporting surface 4. The passages 19, 20 respectively have a basically rectangular opening cross section, the long axis of which is aligned parallel with the longitudinal extent L of the base plate 2. In a central region, the opening cross section of the passages 19, 20 is in addition semicircularly widened in the width direction B of the base plate 2. In this way, the passages 19, 20 are shaped so that a clamping element 21, configured as a locking screw, can be fed through the passages 19, 20 with its head 22 and its threaded shank 23, with the head 22 first.

The head 22 of the clamping element 21 is distinguished in that two cuboid projections 24, which protrude on opposite sides in the radial direction from the threaded shank 23 are formed in its region. The passages 19, 20 are in this case dimensioned in such a way that the head 22 and the shaft 23 can be fed through them with slight clearance.

From its lower face 9, a recess 25, 26, which is aligned concentrically with the respective passage 19, 20, is formed into the base plate 2 in the region of the passages 19, 20. The opening area of the recesses 25, 26 is in this case greater than the opening area of the passages 19, 20 at every position, so that the passages 19, 20 are enclosed by a circumferential collar, on the lower face of which facing towards the respective recess 25, 26 the respective top surface 27, 28 of the relevant recess 25, 26 is formed.

Figure 4:
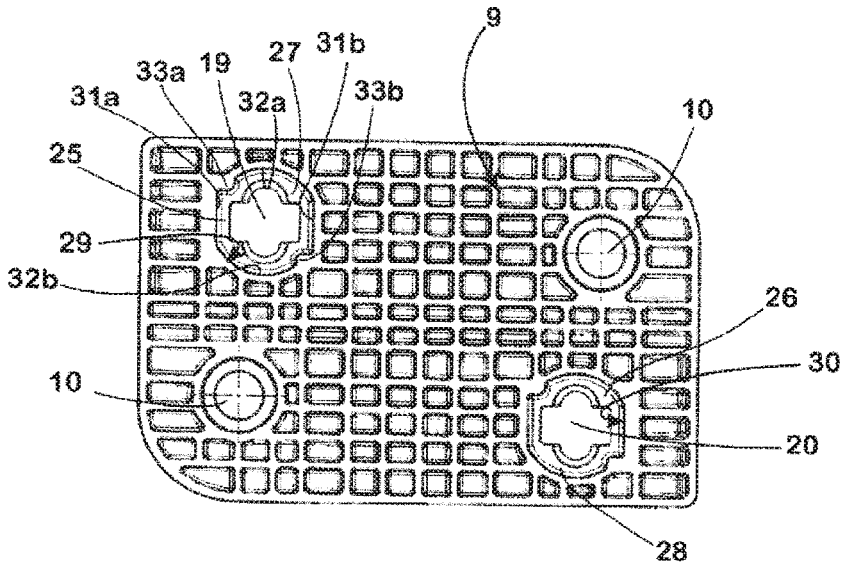
FIG. 4 the base plate according to FIG. 3 in a view from below.

The inner circumferential surfaces 29, 30 of the recesses 25, 26 are shaped point-symmetrically in relation to the respectively assigned passage 19, 20 as seen in a plan view of the lower face of the base plate 2 (FIG. 4). In this case, a straight circumferential wall section 31*a*, 31*b* aligned in the width direction B is respectively followed by a concave inwardly curved section 32*a*, 32*b*, which meets a convex bulging section that is in turn connected to the straight second wall section 31*b* opposite the first straight circumferential wall section 31*a*. The edges delimiting the passage 19, 20 in its central region are chamfered by the respective recess 25, 26, so that a seat tapering conically in the direction of the respective passage 19, 20 is formed there.

The two convex bulging sections formed in this way opposite one another on the circumferential surfaces 29, 30 respectively form an abutment 33*a*, 33*b* for rotationally secure holding of a component fitted into the respective recess 25, 26.

This component is, according to the invention, respectively an insert piece 34, which is cast from a steel casting material and therefore has a very much higher strength and wear resistance than the rest of the material of the base plate 2. The outer shape of the insert pieces 34 fitted into the recesses 25, 26 is matched to the shape of the recesses 25, 26 in such a way that the insert pieces 34 are seated in the respective recess 25, 26 albeit with a sufficient clearance for easy insertion, but accurately. To this end, the insert pieces 34 respectively comprise on their outer circumferential face 35 two diametrically opposite indentations, which form counter-bearings 36*a*, 36*b* by which the insert pieces in the recesses 25, 26 are secured against rotation about the longitudinal axes of the respectively assigned passages 19, 20. The counter-bearings 36*a*, 36*b* are respectively followed by an arch-shaped bulging section 37*a*, 37*b*, which is matched to the inwardly curved section 32*a*, 32*b* of the inner circumferential surfaces 29, 30 of the recesses 25, 26 and respectively merge into a straight section 38*a*, 38*b* of the outer circumferential surface 35, which is matched to the straight section 31*a*, 31*b* of the recess 25, 26.

From its upper face 39, a passage 40 is formed into the insert piece 34, the opening cross section of said passage being rectangularly configured and dimensioned in accordance with the opening cross section of the passages 19, 20 of the base plate 2. In the central region of its longitudinal sides, the passage 40 is respectively oppositely bounded by the halves of a conical heel 41, which is raised on the upper face 39 of the insert piece 34 and the outer circumferential surfaces 35 of which are chamfered in the direction of the longitudinal axis LX of the passage 40, starting from the upper face 39.

By means of the conical heel 41, the insert piece 34 is centred on the chamfered edge regions of the respective passage 19, 20. In this case, its height above the upper face 39 of the insert piece 34 and its circumferential dimensions are matched to the material thickness remaining between the top surface 27, 28 of the respective recess 25, 26 and the upper face 3 of the base plate 2, in such a way that the conical heel 41 engages through the respective passage 19, 20 of the base plate 2 and is aligned with its free side level with the upper face 3 of the base plate. In this case, the conical heel 41 is seated in a self-centring fashion in the region of the circular widening of the passages 19, 20 by means of its conically chamfered surfaces.

At the same time, the insert piece 34 is supported with its upper face 39 against the top surface 27, 28 of the respective recess 25, 26.

Figure 7:
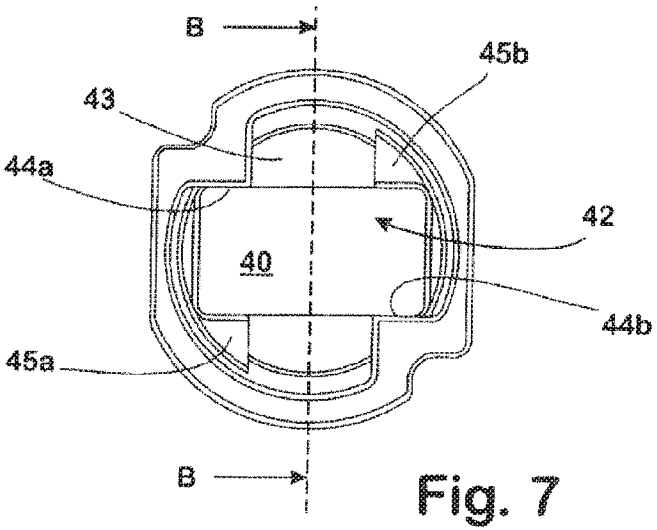
FIG. 7 the insert piece according to FIG. 5 in a view from below.
Figure 5:
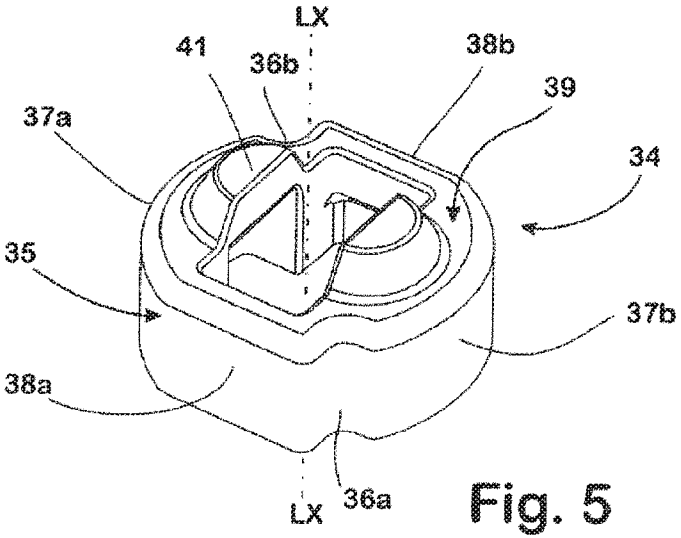
FIG. 5 an insert piece in perspective view.
Figure 8:
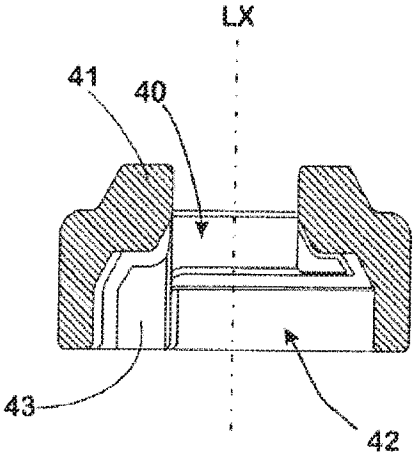
FIG. 8 the insert piece in a section along the section line B-B indicated in FIG. 6.
Figure 6:
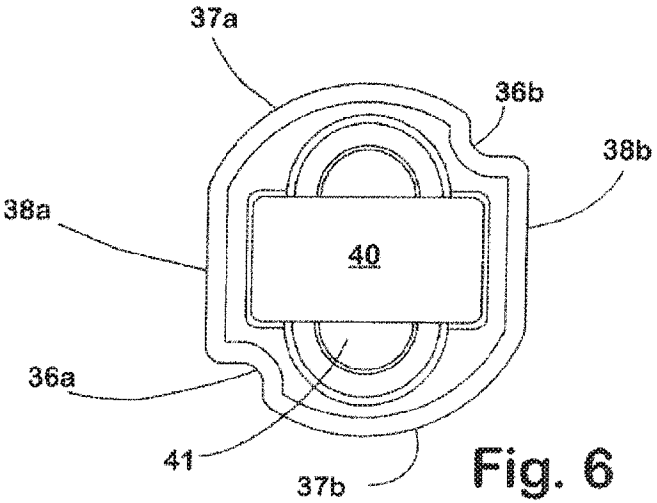
FIG. 6 the insert piece according to FIG. 5 in plan view.

The passage 40 opens in a recess 42, which is formed from its lower face into the respective insert piece 34. The recess 42 has, seen in a plan view of the lower face of the insert piece 34 (FIG. 7), a point-symmetrical configuration. In this case, it has a central cuboid section 43 which is aligned concentrically with the longitudinal axis LX and transversely to the passage 40. This cuboid central section 43 is sunk into the region of the insert piece 3 over which the halves of the conical heel 41 are raised. In the corner regions, assigned to the two counter-bearings 36*a*, 36*b*, diametrically opposite one another and arranged on the outer side of the respective insert piece 34, of the recess 42, a heel respectively used as a stop 44*a*, 44*b* is formed. When the clamping element 21 is fed with its head 22 through the respective passage 19, 20 of the base plate 2 and the passage 40, aligned flush therewith, of the respective insert piece 34, the projections 24 bear laterally on the respectively assigned stop 44*a*, 44*b* and in this way are held rotationally securely against the torques acting on the clamping element 21 during use.

The corner region 45*a*, 45*b* respectively lying opposite the stops 44*a*, 44*b* is, however, lowered over a section in the shape of a quarter circle extending between the central section 43 of the lowered part 42 and the passage 40. In this way, the head 22 of the clamping element 21, after it has passed through the passage 40, may be swivelled through a quarter revolution about the longitudinal axis LX of the passage 40, until its projections 24 are arranged over the further-lowered central section 43 of the recess 42. If the respective clamping element 21 is subsequently loaded in its longitudinal direction in tension out from the recess 42 through the passage 40, the head 22 with its projections 24 is pulled into the central section 43 and is held there rotationally securely.

After the clamping elements 21 have been positioned and locked in this way in the insert pieces 34 seated in the respective recess 25, 26 of the base plate 2, a guide plate 50 configured in the manner of a conventional angle guide plate is respectively placed between the shoulders 14, 15 and the supporting surface 4 of the base plate 2. To this end, the guide plates 50 respectively comprise a centrally arranged passage 40, through which the respectively assigned clamping element 21 is fed with its threaded shank 23 protruding from the respective passage 19, 20.

The guide plates 50 are supported with their one end side on the respective chamfered side of the assigned shoulder 14, 15, and are seated with the heels formed on the lower face in the respectively assigned channel 16, 17 of the base plate 2. The other end side of the guide plate 50, on the other hand, is directed towards the side edge of the rail foot F and in this way forms a lateral guide for the rail S, by means of which transverse forces, which occur when the vehicle passes over the rail fastening point 1, are dissipated into the base plate 2 and from there into the substrate U.

Seated on the guide plates 50, there is respectively a spring element 55 configured in the manner of a conventional ω-shaped tensioning clamp, which acts with the free end of its spring arms on the upper face of the rail foot F. In this case, a plate-shaped insulating element 56, by means of which the spring element 55 and the rail S are electrically insulated from one another, is arranged between the respective end sections of the spring element 55 and the rail foot F.

At the same time, the threaded shank 23 of the respectively assigned clamping element 21 is fed through the central loop 57 of the spring element 55. A nut 58 is screwed onto the end, correspondingly protruding freely over the central loop 57, of the threaded shank 23. This nut is pulled in a manner known per se for spring elements of the type, to which the spring element 55 belongs, to such an extent that the central loop 57 of the respective spring element 55 is swivelled against the upper face 3 of the base plate 2 for the generation of a sufficient retaining force. In this case, even under high tensile loads, the coupling, which takes place according to the invention respectively by means of an insert piece 34 of the respective clamping element 21 onto the base plate 2, ensures that no material fatigue or overloading takes place in the region of the recesses 25, 26 of the base plate 2.

This is assisted by the fact that the insert piece 34 is supported with the free upper face, extending as far as the upper face 3 of the base plate 2, of its conical heel 41 against the lower face of the guide plate 50, so that the guide plate 50 takes away at least some of the forces acting in the longitudinal direction of the clamping element 21, which are absorbed by the insert piece 34. The material present between the top surface 27, 28 of the respective recess 25, 26 and the upper face 3, is then correspondingly relieved of load.

The invention therefore provides a base plate 2, which is made of plastic and is intended for supporting a rail S for a rail vehicle on a substrate U, the base plate 2 comprising a lower face 9 and an upper face 3 on which a supporting surface 4 for the rail S is formed, a recess 25, 26, from which a passage 19, 20 leads to the upper face 3 of the base plate 2, being formed in the lower face 9 of the base plate 2, the diameter of the recess 25, 26 in a direction transverse to the longitudinal axis LX of the passage 19, 20 being greater at least in part than the diameter of the passage 19, 20, so that a stop for an insert piece 34 fitted into the recess 25, 26 is formed on the top surface 27, 28, assigned to the upper face 3 of the base plate 2, of the recess 25, 26, and an abutment 33*a*, 33*b* being provided on an inner surface 29, 30 of the recess 25, 26 for rotationally secure support of the insert piece 34, which is made of a material having a higher strength compared with the plastic material of the base plate 2 and is supported with a counter-bearing 36*a*, 36*b*, formed on one of its outer surfaces 35, on the abutment 33*a*, 33*b* of the recess 25, 26 and with its upper face 39 against the top surface 27, 28 of the recess 25, 26, and a recess 42, in which a passage 40 aligned flush with the passage 19, 20 of the base plate 2 opens, being formed in the insert piece 34 from its lower face, the recess 42 of the insert piece 34 being configured for rotationally secure reception and support of a head 22 of a clamping element 21, the threaded shank 23 of which is fed during use through the passages 40 of the insert piece and base plate 2.

REFERENCES

1 rail fastening point
2 base plate
3 upper face of the base plate 2
4 supporting surface of the base plate 2
5, 6 side sections of the base plate 2
7, 8 corner regions of the side sections 5, 6
9 lower face of the base plate 2
10 passage
11, 12 fastening screws
13 dowel
14, 15 shoulders of the base plate 2
16, 17 channel of the base plate 2
18 web of the base plate 2
19, 20 passages of the base plate 2
21 clamping element
22 head of the clamping element 21
23 threaded shank of the clamping element 21
24 cuboid projections of the head
25, 26 recesses of the base plate 2
27, 28 top surfaces of the recesses 25, 26
29, 30 inner circumferential surfaces of the recesses 25, 26
31*a*, 31*b* straight circumferential wall sections of the inner circumferential surfaces 27, 28
32*a*, 32*b* inwardly curved section of the inner circumferential surfaces 27, 28
33*a*, 33*b* abutment
34 insert piece
35 outer circumferential surface of the insert piece 34
36*a*, 36*b* counter-bearing of the insert piece 34
37*a*, 37*b* outwardly curved sections of the insert piece 34
38*a*, 38*b* straight sections of the insert piece 34
39 upper face of the insert piece 34
40 passage of the insert piece 34
41 conical heel of the insert piece 34
42 recess
43 central cuboid section of the recess 42

44*a*, 44*b* heels used as a stop
45*a*, 45*b* corner regions of the recess 42
50 guide plates
55 spring element
56 insulating element
57 central loop of the spring element
58 nut
B width direction of the base plate 2
E resilient layer
F rail foot
L length/longitudinal extent of the base plate 2
LS longitudinal direction of the rail S
LX longitudinal axis of the passage 40 of the insert piece 34
S rail
U substrate
V vertical direction

The invention claimed is:

1. A base plate, which is made of plastic and is intended for supporting a rail for a rail vehicle on a substrate, the base plate comprising a lower face, assigned to the substrate, and an upper face on which a supporting surface for the rail is formed, at least one recess, from which a passage leads to the upper face of the base plate, being formed in the lower face of the base plate, the diameter of the recess in a direction transverse to the longitudinal axis of the passage being greater at least in part than the diameter of the passage, so that a stop for a component fitted into the recess is formed on a top surface, adjacent to the upper face of the base plate, of the recess, and a component, an abutment for rotationally secure support of the component is provided on an inner surface surrounding the recess, wherein the component fitted into the recess is an insert piece which is made of a material having a higher strength compared with the plastic material of the base plate and is supported with a counter-bearing, formed on one of its outer surfaces, on the abutment of the recess and with its upper face against the top surface of the recess, and wherein the insert piece comprises a lower face, assigned to the lower face of the base plate, starting from which a recess in which a passage formed into the insert piece and aligned flush with the passage of the base plate opens, the recess of the insert piece being configured for rotationally secure reception and support of a head of a clamping element, a threaded shank of which is fed during use through the passages of the insert piece and of the base plate, and at least one shaped element for supporting or guiding at least one component additionally arranged on the base plate is formed on the upper face of the base plate, wherein a heel is formed onto the upper face of the insert piece, and, wherein, in a region in which the passage of the base plate merges into the top surface of the recess of the base plate, a seat for the heel, which is shaped in accordance with the heel, is formed.

2. The base plate according to claim 1, wherein at least the passage of the insert piece has a non-circular opening cross section.

3. The base plate according to claim 2, wherein the opening cross section has a rectangular shape.

4. The base plate according to claim 1, wherein the abutment of the recess of the base plate is formed on an inner circumferential surface of the recess of the base plate and the counter-bearing of the insert piece is formed on an outer circumferential surface of the insert piece.

5. The base plate according to claim 1, wherein at least two distributed abutments of the recess of the base plate are provided, and an equal number of counter-bearings of the insert piece, which are shaped and arranged in accordance with the abutments are provided.

6. The base plate according to claim 5, wherein the abutments the recess of the recess of the base plate and the counter-bearings of the insert piece are distributed at equal angle intervals around the longitudinal axis of the passages of the base plate and insert piece.

7. The base plate according to claim 1, wherein the passage of the insert piece extends through the heel in such a way that the heel bounds the passage of the insert piece at least on two opposite sides.

8. The base plate according to claim 1 wherein the heel is configured as a conical heel.

9. The base plate according to claim 1, wherein the size and shape of the passage of the base plate and the size and shape of the heel are matched to one another in such a way that the heel is aligned with its free upper face at least flush with the upper face of the base plate or protrudes beyond the upper face of the base plate.

10. The base plate according to claim 1, wherein the insert piece is formed from a metal material.

11. A fastening point, at which a rail is fastened on a substrate, comprising a base plate configured according to claim 1, on the supporting surface of which the rail is supported, a spring element which exerts a resiliently elastic retaining force on a foot of the rail to be fastened, and a clamping element which comprises a head, with which it is held rotationally securely in the recess of the insert piece seated in the recess of the base plate, and a threaded shank which is formed onto the head, is fed through the passages of the insert piece and of the base plate and onto which a nut, which is supported on the clamping element by means of the spring element is screwed.

12. The fastening point according to claim 11, wherein the base plate has a rectangular base shape in plan view, over the width of which the supporting surface, arranged centrally in relation to the length of the base plate, on which the rail is supported extends, wherein the recess with the insert piece seated therein is respectively formed in sections of the base plate which protrude laterally beyond the rail.

13. The fastening point according to claim 11, wherein at least one passage leading from the upper face to the lower face, through which a fastening screw that fixes the base plate on the substrate is fed, is additionally formed into the base plate.

14. The fastening point according to claim 13, wherein a second recess with a second insert piece and a second passage is arranged point-symmetrically as seen in a plan view of the base plate in regard to the recess.

15. The fastening point according to claim 11, wherein the shaped element is a shoulder and the additional component is a guide plate, which forms a lateral guide for the rail with the guide plate's end surface assigned to the rail and which guide plate is supported on the shoulder with its opposite end surface, wherein the guide plate comprises a passage, through which the threaded shank of the clamping element is fed, aligned flush with the passages of the base plate and of the insert piece, and wherein the spring element is supported on the guide plate.

* * * * *